US011850495B2

(12) United States Patent
Nock

(10) Patent No.: US 11,850,495 B2
(45) Date of Patent: Dec. 26, 2023

(54) CARRIER STRAPS FOR WEIGHT PLATES

(71) Applicant: Steven Nock, Henrico, VA (US)

(72) Inventor: Steven Nock, Henrico, VA (US)

( * ) Notice: Subject to any disclaimer, the term of this patent is extended or adjusted under 35 U.S.C. 154(b) by 114 days.

(21) Appl. No.: 17/407,727

(22) Filed: Aug. 20, 2021

(65) Prior Publication Data

US 2022/0054923 A1 Feb. 24, 2022

Related U.S. Application Data

(60) Provisional application No. 63/069,099, filed on Aug. 23, 2020.

(51) Int. Cl.
*A63B 71/00* (2006.01)
*A63B 21/072* (2006.01)

(52) U.S. Cl.
CPC ..... *A63B 71/0036* (2013.01); *A63B 21/072* (2013.01)

(58) Field of Classification Search
CPC ..... A63B 21/072–075; A63B 23/1218; A63B 5/20
See application file for complete search history.

(56) References Cited

U.S. PATENT DOCUMENTS 2,118,114 A * 5/1938 Schenk ..... A63B 21/0004 482/126
3,219,342 A * 11/1965 Melchiona ..... A63B 21/045 482/126
4,023,808 A * 5/1977 Hebert ..... A63B 21/0004 482/126
4,681,315 A * 7/1987 Yang ..... A63B 21/0726 482/50
4,909,505 A * 3/1990 Tee ..... A63B 21/0552 482/121
4,911,439 A * 3/1990 Kuhl ..... A63B 21/4025 482/124
5,518,481 A * 5/1996 Darkwah ..... A63B 21/4025 482/126
5,620,397 A * 4/1997 Chieh ..... A63B 21/0004 482/121
5,727,833 A * 3/1998 Coe ..... B66C 1/12 73/862.56
6,447,037 B1 * 9/2002 Crouch ..... B65D 33/14 294/149
6,672,997 B1 * 1/2004 Winkler ..... A63B 21/0552 482/121
7,044,894 B1 * 5/2006 Smith ..... A63B 21/0004 482/121

(Continued)

*Primary Examiner* — Nyca T Nguyen
(74) *Attorney, Agent, or Firm* — Rothwell, Figg, Ernst & Manbeck, P.C.

(57) ABSTRACT

Disclosed are compact, convenient carrier systems for weight plates. In some embodiments, a carrier system may include a strap, a carrying handle, and rigid loading bar. The loading bar may be a tubular member. The carrying handle may have an outer diameter that permits the carrying handle to be slidably disposed within the inner diameter of the loading bar. In some embodiments, the loading bar may have an outer diameter that permits the loading bar to fit within the central opening on a standard Olympic weightlifting weight plate. The carrier system may optionally provide a clip closure attached to the strap that allows easy opening and closing of the system.

19 Claims, 5 Drawing Sheets

(56) References Cited

U.S. PATENT DOCUMENTS 7,652,953 B1 * 1/2010 Fluegge ..... A63B 21/00043 482/131
7,931,572 B1 * 4/2011 Glauser ..... A63B 21/0004 482/126
8,012,071 B2 * 9/2011 Grisdale ..... A63B 21/0552 482/125
D678,434 S * 3/2013 Hughes ..... D21/692
8,894,556 B2 * 11/2014 Webb ..... A63B 21/075 482/126
9,592,418 B2 * 3/2017 Burrell ..... A63B 21/00043
9,635,925 B2 * 5/2017 Moreau ..... A45F 5/00
9,868,013 B1 * 1/2018 Leverenz ..... A61H 1/0244
10,384,094 B1 * 8/2019 Newman ..... A63B 21/4035
10,398,923 B2 * 9/2019 Hur ..... A63B 21/0552
10,610,760 B2 * 4/2020 Nowlan ..... A63B 71/0036
10,695,603 B1 * 6/2020 Lamping ..... A61H 3/00
11,033,774 B1 * 6/2021 Clarke ..... A63B 21/00185
11,400,334 B2 * 8/2022 Hetrick ..... A63B 21/4043
11,497,259 B1 * 11/2022 Womack ..... A41D 13/0512
2006/0160679 A1 * 7/2006 Kung ..... A63B 21/0004 482/121
2007/0225134 A1 * 9/2007 Slattery ..... A63B 23/02 482/92
2012/0108403 A1 * 5/2012 Zandman-Zeman ..... A63B 21/0555 482/121
2014/0228180 A1 * 8/2014 Walker ..... A63B 21/0557 482/82
2015/0024908 A1 * 1/2015 Hall ..... A63B 21/0722 482/93
2015/0141217 A1 * 5/2015 Young ..... A63B 21/4031 482/126
2016/0095420 A1 * 4/2016 Moreau ..... A45F 5/021 248/317
2016/0095421 A1 * 4/2016 Moreau ..... F16B 45/00 248/317
2017/0021219 A1 * 1/2017 Kelly ..... A63B 21/4033
2017/0050065 A1 * 2/2017 Carter ..... A63B 21/16
2017/0127814 A1 * 5/2017 Mundy ..... B65G 7/12
2018/0185692 A1 * 7/2018 Wailes ..... A61H 1/02
2019/0060696 A1 * 2/2019 Moore ..... A63B 21/0428
2019/0314666 A1 * 10/2019 Mantione, III .... A63B 21/1645
2020/0023228 A1 * 1/2020 Yang ..... A63B 21/16
2020/0078628 A1 * 3/2020 Parise ..... A63B 21/0557
2020/0086162 A1 * 3/2020 Garcia ..... A63B 21/4007
2020/0164244 A1 * 5/2020 Gilmore ..... A63B 21/151
2021/0178216 A1 * 6/2021 Ducato ..... A63B 23/1236
2022/0212073 A1 * 7/2022 Mccuaig ..... A63B 60/06

* cited by examiner

CARRIER STRAPS FOR WEIGHT PLATES

CROSS-REFERENCE TO RELATED APPLICATIONS

This application claims the benefit of U.S. Provisional Patent Application No. 63/069,099, filed Aug. 23, 2020, which is hereby incorporated by reference in its entirety.

BACKGROUND

Weightlifting is a popular physical activity. Standard weight plates are typically loaded onto metal barbells for exercises such as bench press, squats, Olympic lifting, and the like. Such plates may be made of metal such as iron or steel, or may be "bumper plates" such as those made of dense rubber for Olympic lifting and similar activities. The plates have a circular opening in the middle that allows the plate to be loaded onto a standard barbell. Rubber bumper plates typically, but not always, have a metal collar around the center opening to provide strength and to facilitate loading onto the bar. Weight plates are made in standardized weights, such as 15, 25, 35, and 45 pound plates, or 5, 10, 15, and 20 kilogram plates. Weight plates are generally flat cylinders, but may vary in circumference and thickness depending on the material from which they are constructed (e.g., metal or rubber) and depending on the manufacturer.

There is a need for an improved and convenient system for carrying standard weight plates.

SUMMARY

The following description presents a simplified summary in order to provide a basic understanding of some aspects described herein. This summary is not an extensive overview of the claimed subject matter. It is intended to neither identify key or critical elements of the claimed subject matter nor delineate the scope thereof.

In some embodiments, a system may allow multiple standard weight plates to be moved from one location to another. An exemplary carrier system may be used for exercise, or for transportation of the weight plates. For example, the carrier system may be used for farmer's carry exercises, in which the user carries weights at his or her side while walking or jogging. The system also may be used for exercises such as curls or rows in which the user repeatedly lifts the weights from the floor to a predetermined location.

In some embodiments, a system may eliminate the need for specialized equipment such as kettlebells or dumbbells to perform such exercises. Kettlebells and dumbbells are disadvantageous in that they are typically sold in pre-set weights such that a large number of pieces of equipment are needed to accommodate different exercises and different users. By contrast, embodiments of the systems described herein may allow the user to adjust weights using standard weight plates that can also be used for barbell exercises. The present systems may also conveniently allow for moving multiple weight plates at a time from one location to another, such as when moving equipment to an outdoor space for use, moving weights into a vehicle, or moving gym equipment to a new location.

In some embodiments, a system for carrying weight plates may include one or more of a first tubular member, a second tubular member, and a strap. The strap may be disposed axially through an interior of the first tubular member and an interior of the second tubular member. In some embodiments, the strap may have a first end and a second end. The first end of the strap may be terminated with a fastener.

Further variations encompassed within the systems and methods are described in the detailed description of the invention below.

BRIEF DESCRIPTION OF THE DRAWINGS

The accompanying drawings, which are incorporated herein and form part of the specification, illustrate various, non-limiting embodiments of the present invention. In the drawings, like reference numbers indicate identical or functionally similar elements.

FIG. 1(*b*) illustrates an exemplary embodiment of the carrier system in the closed position.

DETAILED DESCRIPTION

Figure 1A:
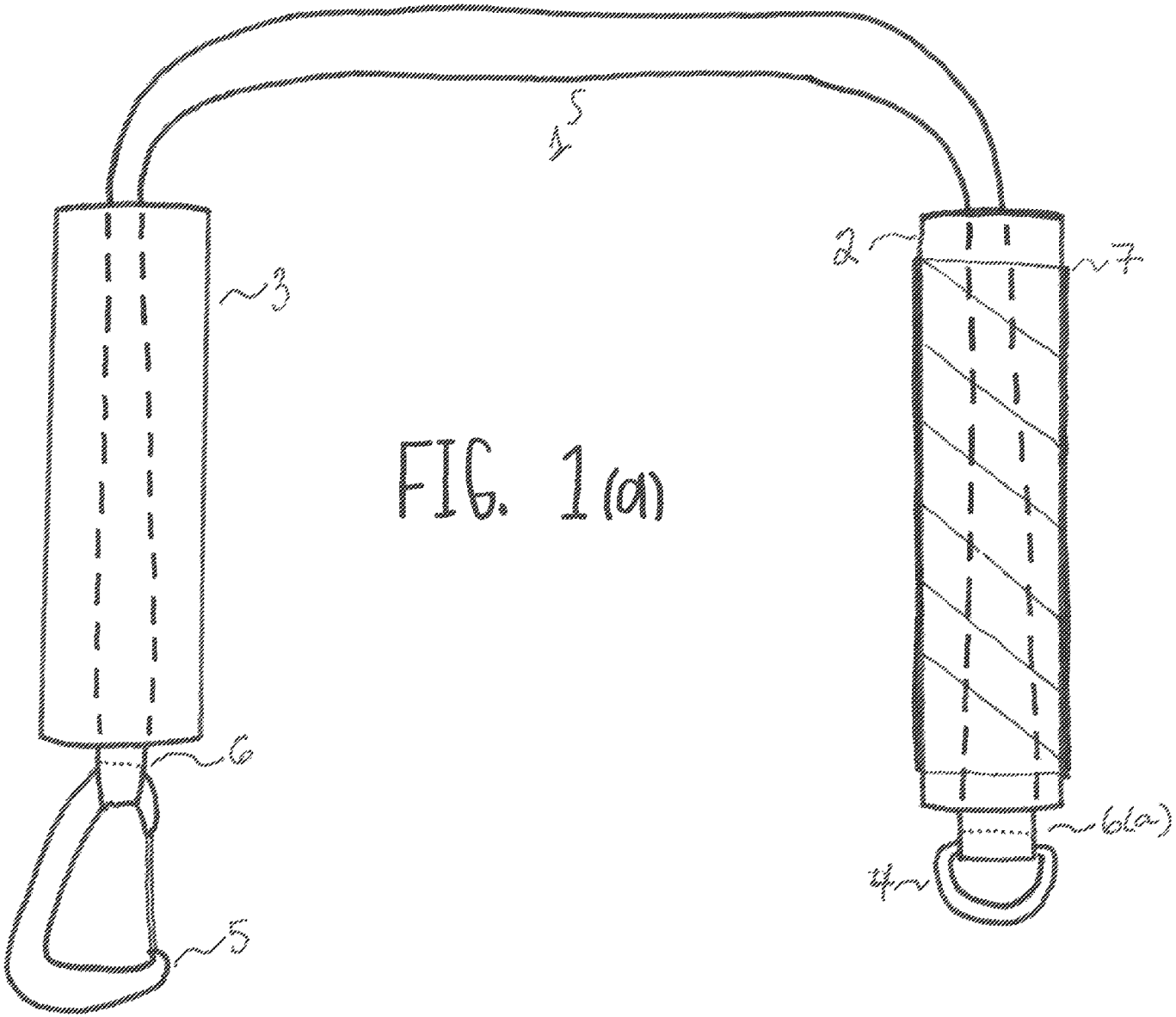
FIG. 1(*a*) illustrates an exemplary embodiment of the carrier system in the open position such that weight plates can be loaded onto the loading bar.
Figure 1A:
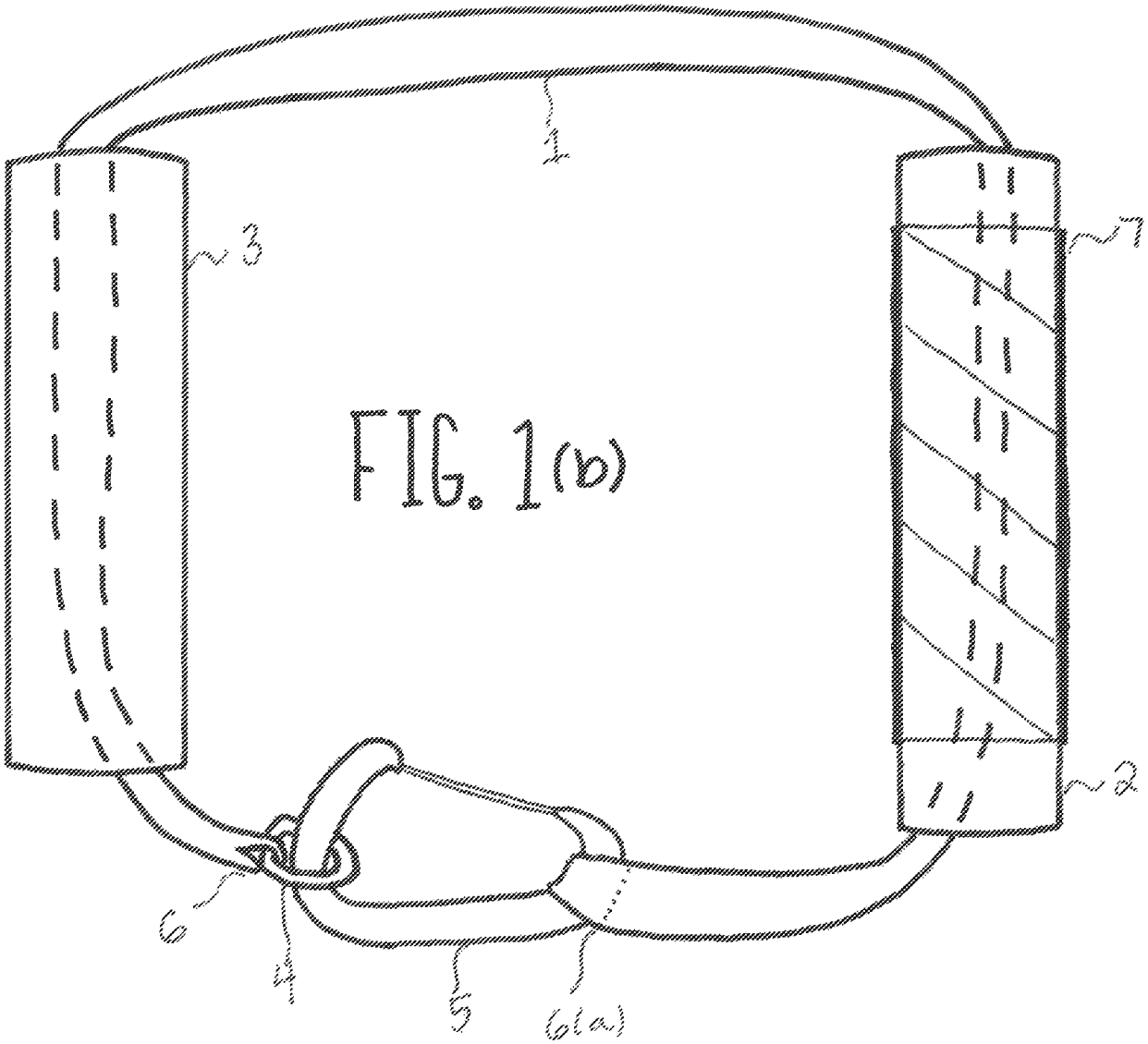

FIG. 1 illustrates an exemplary embodiment of a carrier system. The carrier system may include a strap (1), a carrying handle (2), and a loading bar (3). The strap may be threaded axially through the length of the inner opening of each of the carrying handle and the loading bar. The strap may have a first end and a second end, and may be terminated on each end with a fastener. In one embodiment, the strap may be terminated on a first end with a ring (4) and terminated on a second end with a clip or carabiner (5). The strap may have a fabric loop (6, 6*a*) at each end to connect to the fastener. In another embodiment, the strap may be terminated on a first end with a fabric loop and terminated on a second end with a clip or carabiner. In another embodiment the strap may be terminated on a first end with an S-hook and terminated on a second end with a second S-hook, a ring, or a fabric loop. The fastener may be preferably selected to have a cross-sectional size that may be small enough to allow the fastener to pass through the center of a standard weight plate, but large enough that it cannot pass through the loading bar. In a preferred embodiment, the fastener may be a three inch long carabiner and a ring or D-ring.

As shown in FIG. 1(*a*), the system may be arranged with the fastener in a disconnected or "open" configuration. In FIG. 1(*b*), the system is depicted with the fastener in a connected or "closed" configuration.

Figure 2:
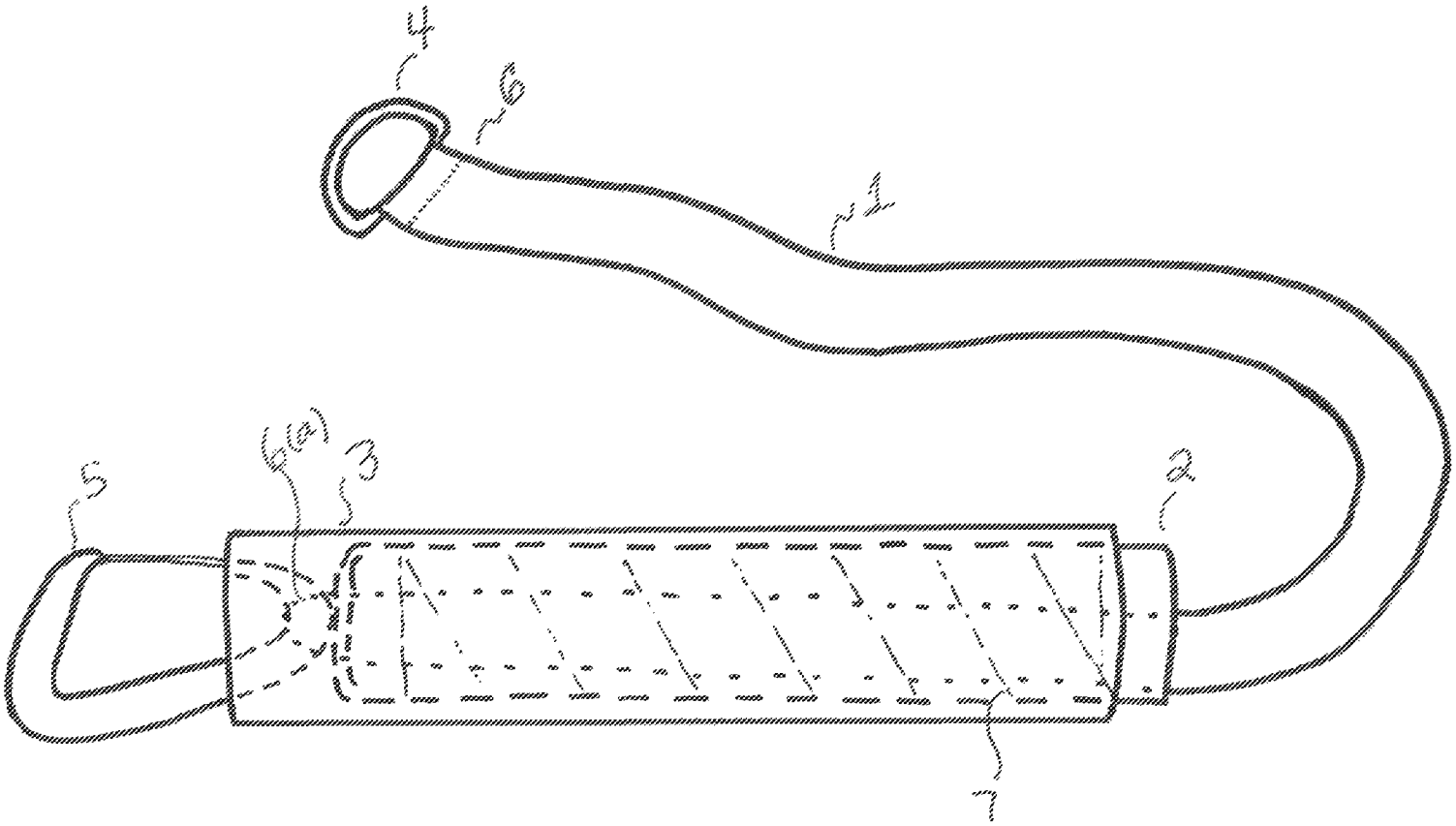
FIG. 2 illustrates an exemplary embodiment of the carrier system in which the carrying handle is disposed axially within the inner diameter of the loading bar.

The carrying handle (2) and the loading bar (3) may be tubular structures, and may be slidably disposed on the strap (1). The strap may be threaded axially through the length of the inner opening of each of the carrying handle and the loading bar. The diameters of the tubular members may be preferably selected such that the carrying handle (2) has an outer diameter that may be smaller than the inner diameter for the loading bar (3). This allows the carrying handle to be slidably disposed within the loading bar for compact storage of the carrier system. FIG. 2 illustrates the carrying handle disposed within the loading bar, and the strap threaded through the inner opening of the carrying handle. The configuration illustrated in FIG. 2 may be utilized when the system is stored.

The carrying handle and the loading bar each may be constructed of a strong but lightweight plastic, such as polyvinylchloride (PVC), polyethylene terephthalate (PET), acrylonitrile butadiene styrene (ABS), polycarbonate (PC), polydicyclopentadiene (pDCPD), polypropylene (PP), or the like. Alternatively, the carrying handle and the loading bar each may be constructed of metal, such as steel, stainless steel, cast iron, aluminum, titanium or the like. The carrying handle and the loading bar need not be made from the same material. Any combination of the foregoing materials is acceptable. For example, the carrying handle member may be constructed of PVC and the loading bar may be constructed of stainless steel. In a preferred embodiment, both the carrying handle and the loading bar may be constructed of PVC. In a second preferred embodiment, both the carrying handle and the loading bar may be constructed of stainless steel. In a third preferred embodiment, the carrying handle may be constructed of PVC and the loading bar may be constructed of cast iron or stainless steel.

The carrying handle may be coated with a soft coating (7) for comfort. For example, the carrying handle may be wrapped with grip tape or athletic tape, such as a fabric tape made of cotton, polyester, or a cotton-polyester blend, or silicone-based tape such as knurled silicone tape. Alternatively, the carrying handle may be coated with a softer grip material such as nitrile PVC (NPVC) foam, ethylene-propylene-diene monomer (EPDM) foam, neoprene, rubber, or silicone. The coating material may be smooth or may have a textured surface for reduced slippage. When the carrying handle is constructed of metal, the metal may have a knurled surface to provide a better gripping surface. The grip material may cover the entire outer surface of the handle member. Alternatively, the grip material may be affixed to a portion of the outer surface of the handle member, preferably the center portion of the handle member.

The carrying handle (2) may be preferably constructed as a hollow tube such that the strap (1) can be threaded axially through the length of the carrying handle. The carrying handle preferably may have an outer diameter of approximately 1 inch, or more preferably 1 and 5/16 inches. The carrying handle preferably may have an inner diameter of approximately 1 inch. When constructed of PVC, the thickness of the wall of the carrying handle (6) may be approximately 1/4 inch or more preferably about 3/16 inch. The carrying handle may be preferably about 9 inches long. In an alternative embodiment, the carrying handle may be about 8 inches long. In another alternative embodiment, the carrying handle may be about 7 inches long. In another alternative embodiment, the carrying handle may be about 6 inches long. In a preferred embodiment, the fastener may be selected to have a cross-section that is larger than the inner diameter of the carrying handle. This prevents the strap from inadvertently pulling through the carrying handle or becoming disconnected from the carrier system.

The loading bar may hold the weight plates when the system is in use. The loading bar (3) may be preferably constructed as a hollow tube such that the strap (1) and the carrying handle (2) can be threaded through the length of the loading bar (3). The loading bar may preferably have an outer diameter of approximately 2 inches, or more preferably, 1 and 15/16 inches. The loading bar preferably may have an inner diameter of about 1 inch, or more preferably at least 1 and 3/8 inches, or most preferably about 1 and 9/16 inches. When constructed of PVC, the thickness of the wall of the loading bar may be approximately 1/4 inch or more preferably about 3/16 inch. In a preferred embodiment, the fastener may be selected to have a cross-section that may be larger than the inner diameter of the loading bar. This may prevent the strap from inadvertently pulling through the loading bar or becoming disconnected from the carrier system.

Figure 3:
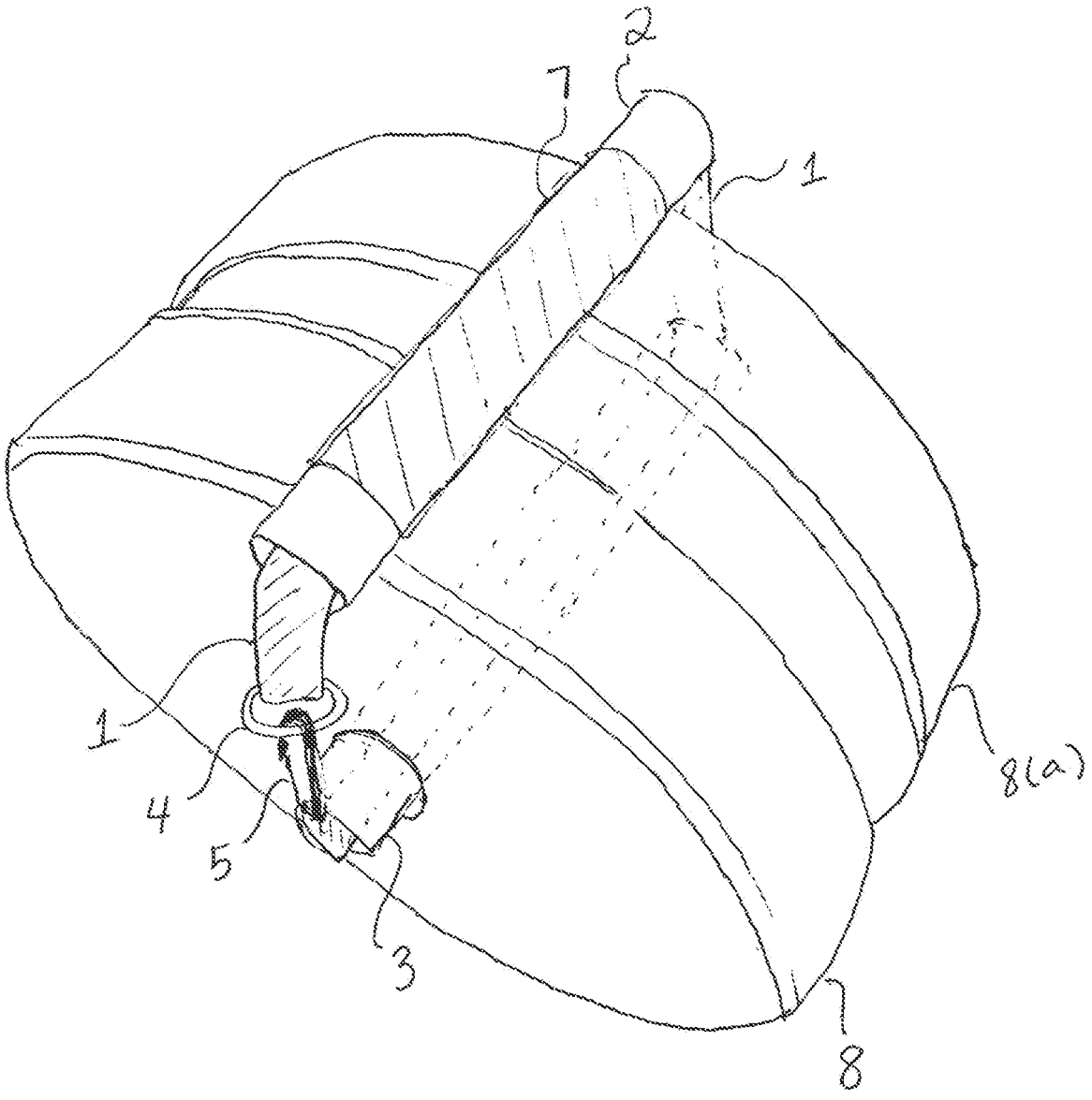
FIG. 3 illustrates the carrier system in the closed position and loaded with two 45 pound bumper plates on the loading bar.

The loading bar may be preferably about 9 inches long. In an alternative embodiment, the loading bar may be about 8 inches long. In another alternative embodiment, the loading bar may be about 7 inches long. In another alternative embodiment, the loading bar may be about 6 inches long. A tubular member that is 6 inches long may accommodate two standard 45 pound bumper plates (manufactured by, e.g., Rogue Fitness), allowing a user to carry up to 90 pounds in a single hand. A tubular member that is approximately 9 inches long may accommodate two standard 45 pound bumper plates as well as an additional 10 pound, 15 pound, 25 pound, or 45 pound bumper plate, allowing a user to carry up to 135 pounds in a single hand. Standard metal weight plates generally are thinner for the same weight, allowing even more weight to be loaded onto the loading bar. FIG. 3 illustrates the carrier system with two 45-pound bumper plates (8, 8(*a*)) loaded onto the loading bar (3). The loading bar (3) may fit through the center hole in the weight plates. The strap (1) may be disposed axially through the interior opening of the tubular loading bar (3). The strap (1) also may be disposed axially through the interior opening of the tubular carrying handle (2), and the fastener (4, 5) may be closed. In this configuration, when a user engages the carrying handle, the strap, loading bar, and weight plates also are engaged so that the user can carry the entire assembly.

In an embodiment, the loading bar can be removed from the system. In this embodiment, the loading bar may be removed and replaced with a different loading bar (e.g., a loading bar having a longer length to accommodate additional weight plates). The selection of the fastener attached to the strap may allow the loading bar to be removed at the user's option. For example, the user may remove a clip, carabiner, or S-hook from the second end of the strap (located proximal to the loading bar), and then slide the loading bar off of the strap.

The use of a rigid or semi-rigid loading bar may beneficially allow the weight plates to be loaded onto the carrier system with greater ease compared to the strap alone. Additionally, the use of a rigid or semi-rigid loading bar may ensure that the weight plates are carried at a consistent height from the ground. This avoids sagging or scraping the weights on the ground. Further, the loading bar may hold the weight plates at a consistent angle, which may prevent the weight plates from tipping when the carrier system is set down. This increases the safety of the system by avoiding situations in which the weight plates fall into the user's legs or onto the ground when the carrier system is set down.

In a particularly preferred embodiment, the carrying handle may be made of PVC and has an outer diameter of approximately 1 and 5/16 inches and a length of about 9 inches, and the loading bar may be made of PVC and has an outer diameter of approximately 1 and 15/16 inches, an inner diameter of about 1 and 9/16 inches, and a length of about 9 inches. In this embodiment, the strap may be approximately 36 inches in length and may be terminated on a first end with a fastener comprising a ring and terminated on the second end with a fastener comprising a clip or carabiner. Less preferably, when the carrying handle and the loading bar each have a length of about 9 inches, the strap may be approximately 35 inches, 34 inches, or 33 inches in length.

Through extensive testing, the inventor has determined that the carrier system provides optimal comfort to an adult user when the carrier handle and loading bar are each approximately 9 inches in length and the strap may be approximately 36 inches in length. This configuration allows easy loading of large bumper plates, provides optimal clearance for the user's grip, and generally prevents the bumper plates from contacting the ground or floor when the carrier system may be used in a farmer's carry position (i.e., with the user's arms extended at his or her side).

In a second particularly preferred embodiment, the carrying handle may be made of PVC and has an outer diameter of approximately 1 and 5/16 inches and a length of about 7 inches, and the loading bar may be made of PVC and has an outer diameter of approximately 1 and 15/16 inches, an inner diameter of about 1 and 9/16 inches, and a length of about 7 inches. In this embodiment, the strap may be approximately 36 inches in length and may be terminated on a first end with a fastener comprising a ring and terminated on the second end with a fastener comprising a clip or carabiner. In other embodiments, when the carrying handle and the loading bar each have a length of about 7 inches, the strap may be approximately 35 inches, 34 inches, 33 inches, 32 inches, 31 inches, or 30 inches in length.

The strap (1) may be threaded through the carrying handle (2) and the loading bar (3). The strap may be preferably made of nylon webbing, but may also be made from other strong and resilient fabrics. The strap could also be made of any rope material, including metal rope, synthetic rope, natural fiber rope, or flexible metal chain. Rope material optionally may be coated with plastic casing. The strap may be preferably about 36 inches long. In an alternative embodiment, the strap may be about 35 inches, 34 inches, 33 inches, 32 inches, 31 inches, 30 inches, 29 inches, 28 inches, 27 inches, 26 inches, 25 inches, 24 inches, 23 inches, 22 inches, 21 inches, or 20 inches. The length of the strap may be selected such that it leaves adequate space for the carrying handle to be grasped by a hand when standard weight plates have been loaded on the loading bar. For example, the diameter of a typical 45 pound bumper plate may be approximately 445 millimeters or 450 millimeters (i.e., about 17.5 inches to about 18 inches). The strap therefore must allow about 9 inches of clearance on each side of the tubular member. The fastener located on each end of the strap provides additional clearance space, the length of which varies depending on which fastener is selected.

Figure 4:
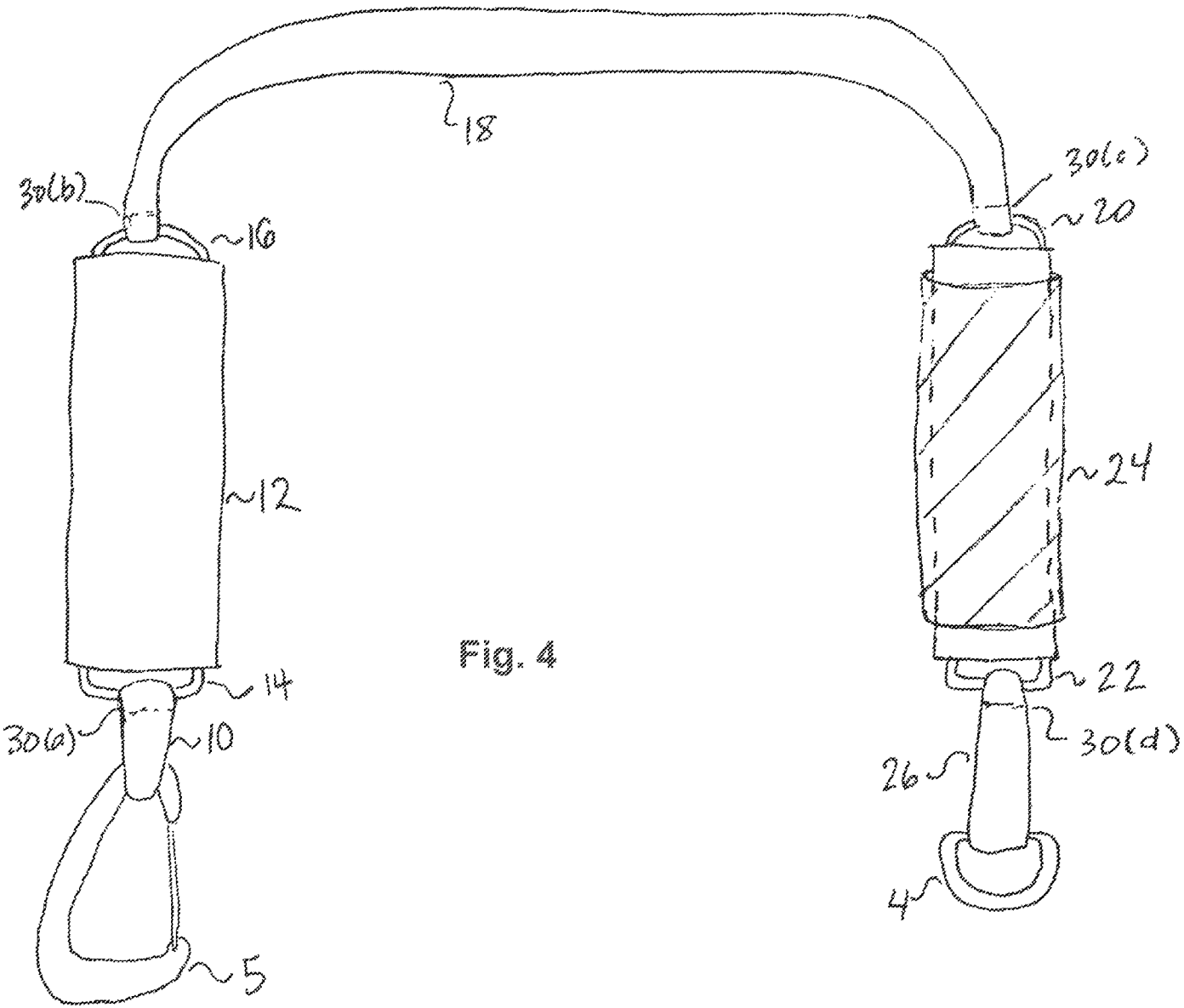
FIG. 4 illustrates an embodiment of the carrier system in which each end of the loading bar and the carrying handle is equipped with attachment means for a carrier strap. The carrier system is illustrated in the open position.

In an alternative embodiment illustrated in FIG. 4, the carrier system may be comprised of three straps (10, 18, 26), a handle member (32), and a loading member (12). The handle member (32) and the loading member (12) may each have a first end and a second end. Each of the first and second ends of the handle member and the loading member may have a connector (14, 16, 20, 22). In some embodiments, the connector may be a metal loop, buckle clip, or snap closure. In this embodiment, the handle member and the loading member may each independently may be a solid cylinder, a hollow cylinder with closed ends, or an open tube (i.e., a hollow cylinder with open ends).

A first strap (10) may be attached to the connector (14) on the first end of the loading member. The first end of the first strap (10) may be terminated in or attached to a fastener (5). For example, the fastener may be a carabiner, a clip, a ring, an S-hook, a fabric loop, or the like. As illustrated in FIG. 4, the first strap (10) may form a loop that attaches to the fastener, e.g., a carabiner (5). The first strap (10) may be attached at its second end to the attachment means (14) on the first end of the loading member. A fabric loop (30(*a*)) optionally may be utilized to secure the strap to the attachment means.

The attachment means (16) on the second end of the loading member may be attached to the first end of a second strap (18). The second strap (18) may be attached at its second end to the attachment means (20) on the first end of the handle member (32).

The handle member (32) serves as a handle when the system is in operation, and may be coated with a grip material (24). The grip material (24) on the handle member may be a wrapping of grip tape or athletic tape, such as a fabric tape made of cotton or polyester, or a silicon tape. Alternatively, the carrying handle may be coated with a softer grip material such as nitrile PVC (NPVC) foam, ethylene-propylene-diene monomer (EPDM) foam, neoprene, rubber, or silicone. The coating material may be smooth or may have a textured surface for reduced slippage. When the handle member is constructed of metal, the metal may have a knurled surface to provide a better gripping surface.

The attachment means (22) on the second end of the handle member may be attached to the third strap (26). The third strap may be attached at its first end to the handle member via the attachment means (22). A fabric loop (30(*d*)) optionally may be utilized to secure the strap to the attachment means. The second end of the third strap (26) may be terminated in or affixed to a fastener (4). The fastener may be a carabiner, a clip, a ring, an S-hook, a fabric loop, or the like. The fastener (4) attached to the third strap may be selected to be complementary to the fastener attached to the first strap, such that the two fastener operate together to allow the carrier system to be opened and closed to allow weight plates to be loaded onto, and unloaded from, the loading member. For example, the two fastener (4, 5) may be a pair of S-hooks; a carabiner and a ring; a carabiner and a fabric loop, or an S-hook and a fabric loop.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure. Moreover, the descriptions of such embodiments, combinations, and sub-combinations is not intended to convey that the claimed subject matter requires features or combinations of features other than those expressly recited in the claims. Accordingly, the scope of this disclosure is intended to include all modifications and variations encompassed within the spirit and scope of the following appended claims.

I claim:

1. A system for carrying weight plates, the system comprising:

a first tubular member, a second tubular member, and a strap, wherein the strap is disposed axially through an interior of the first tubular member and the strap is disposed axially through an interior of the second tubular member, and wherein the strap has a first end and a second end, wherein the first end of the strap is terminated with a fastener, and wherein the outer diameter of the second tubular member is smaller than the inner diameter of the first tubular member, such that the second tubular member is configured to be disposed within the first tubular member for storage.

2. The system of claim 1, wherein the first end of the strap is terminated with the fastener comprising a ring.

3. The system of claim 2, wherein the second end of the strap is terminated with a second fastener comprising a clip.

4. The system of claim 3, wherein the clip is made of metal.

5. The system of claim 3, wherein the clip is disposed within a fabric loop at the second end of the strap.

6. The system of claim 2, wherein the ring is made of metal.

7. The system of claim 2, wherein the ring is disposed within a fabric loop at the first end of the strap.

8. The system of claim 1, wherein the second tubular member further comprises a soft grip material around at least a portion of its outer diameter, and wherein the first tubular member does not comprise a soft grip material.

9. The system of claim 8, wherein the soft grip material comprises fabric tape or silicone tape.

10. The system of claim 1, wherein the system is configured to support at least 90 pounds.

11. The system of claim 10, wherein the system is configured to support at least two 45 pound bumper plates.

12. The system of claim 1, wherein the first tubular member is made of a rigid material.

13. The system of claim 12, wherein the second tubular member is made of a rigid material.

14. The system of claim 1, wherein the first tubular member is made of polyvinyl chloride (PVC).

15. The system of claim 13, wherein the second tubular member is made of polyvinyl chloride (PVC).

16. The system of claim 1, wherein the outer diameter of the first tubular member is approximately 1 and 15/16 inches to approximately 2 inches.

17. The system of claim 16, wherein the first tubular member has a wall thickness of approximately 3/16 inch to approximately 1/4 inch.

18. The system of claim 16 wherein the length of the first tubular member is approximately 6 inches to approximately 9 inches.

19. The system of claim 1, further comprising a weight plate disposed on the outer diameter of the first tubular member.

* * * * *